US008165731B2

(12) United States Patent
Akcasu

(10) Patent No.: US 8,165,731 B2
(45) Date of Patent: Apr. 24, 2012

(54) SYSTEM FOR AERIAL DELIVERY OF FIRE RETARDANT

(75) Inventor: Osman Ersed Akcasu, Morgan Hill, CA (US)

(73) Assignee: Lonestar Inventions, L.P., Austin, TX (US)

( * ) Notice: Subject to any disclaimer, the term of this patent is extended or adjusted under 35 U.S.C. 154(b) by 794 days.

(21) Appl. No.: 12/210,100

(22) Filed: Sep. 12, 2008

(65) Prior Publication Data

US 2010/0070111 A1 Mar. 18, 2010

(51) Int. Cl.
*A62C 3/02* (2006.01)

(52) U.S. Cl. ..... 701/3; 701/10; 701/23; 701/24; 701/25; 701/26; 701/400; 701/410; 701/413; 701/415; 102/367; 102/369; 102/384; 244/3.1; 244/3.15; 244/136; 169/46; 169/47; 169/5; 169/16; 169/28; 169/26

(58) Field of Classification Search ..... None
See application file for complete search history.

(56) References Cited

U.S. PATENT DOCUMENTS

| | | | | |
|---|---|---|---|---|
| 3,754,601 | A * | 8/1973 | Linkewich | 169/44 |
| 4,344,489 | A * | 8/1982 | Bonaparte | 169/70 |
| 5,070,945 | A * | 12/1991 | Nahmias | 169/46 |
| 5,549,259 | A * | 8/1996 | Herlik | 244/136 |
| 5,794,889 | A * | 8/1998 | Bailey | 244/136 |
| 6,470,805 | B1 * | 10/2002 | Woodall et al. | 102/370 |
| 6,581,878 | B1 * | 6/2003 | Bennett | 244/136 |
| 7,121,353 | B2 * | 10/2006 | Setzer | 169/28 |
| 7,451,679 | B2 * | 11/2008 | Stevenson et al. | 89/1.51 |
| 7,599,765 | B2 * | 10/2009 | Padan | 701/3 |
| 7,690,438 | B2 * | 4/2010 | Bordallo lvarez | 169/47 |
| 7,735,781 | B1 * | 6/2010 | Moritz et al. | 244/137.1 |
| 7,836,965 | B2 * | 11/2010 | Korenkov et al. | 169/28 |
| 2002/0157558 | A1 * | 10/2002 | Woodall et al. | 102/369 |
| 2005/0072880 | A1 * | 4/2005 | Nolan | 244/136 |

(Continued)

FOREIGN PATENT DOCUMENTS

EP 1845017 A2 10/2007

OTHER PUBLICATIONS

Akcasu, "Convergence Properties of Newton's Method for the Solution of Semiconductor Carrier Transport Equations and Hybrid Solution Techniques for Multidimensional Simulation of VLSI Devices," Solid-State Electronics (Apr. 1984) vol. 27, pp. 319-328.

(Continued)

*Primary Examiner* — Jonathan M Dager
(74) *Attorney, Agent, or Firm* — Kilpatrick Townsend & Stockton LLP; Kenneth R. Allen

(57) ABSTRACT

A system for launching, controlling and delivering in a preselected target pattern a plurality of low-cost, guided fire-retardant-containing vehicles, i.e., "smart water bombs" equipped with control surfaces sufficient to provide limited lift and maneuverability to respond to guidance command to place it at a selected GPS coordinate within a large footprint in time and space and to discharge its payload of fire retardant at a preselectable altitude in a very precise manner and dispersion pattern. A controller determines bombing patterns and timing for all bombs and trajectories for each guided bomb. Dynamic differential equations are used to determine location and time of release of the guided bombs to achieve the target while avoiding collisions among guided bombs and aircraft.

8 Claims, 9 Drawing Sheets

U.S. PATENT DOCUMENTS

| | | | | |
|---|---|---|---|---|
| 2005/0139363 | A1* | 6/2005 | Thomas | 169/30 |
| 2006/0162941 | A1* | 7/2006 | Sridharan et al. | 169/53 |
| 2006/0260826 | A1* | 11/2006 | Hutter et al. | 169/51 |
| 2006/0271245 | A1* | 11/2006 | Herman | 701/1 |
| 2007/0007021 | A1* | 1/2007 | Regan | 169/84 |
| 2007/0021879 | A1* | 1/2007 | DelNero et al. | 701/23 |
| 2007/0288156 | A1* | 12/2007 | Neff et al. | 701/202 |
| 2008/0202775 | A1* | 8/2008 | Bordallo Alvarez | 169/47 |
| 2008/0208397 | A1* | 8/2008 | Miklos | 701/3 |
| 2009/0065646 | A1* | 3/2009 | Hale et al. | 244/136 |
| 2009/0212251 | A1* | 8/2009 | Taylor | 252/2 |
| 2010/0036549 | A1* | 2/2010 | Kwan et al. | 701/7 |
| 2010/0274487 | A1* | 10/2010 | Neff et al. | 701/302 |

OTHER PUBLICATIONS

The extended European Search Report corresponding to the Application No. 09169974.4-1258, dated Dec. 16, 2009, 5 pages total.

* cited by examiner

SYSTEM FOR AERIAL DELIVERY OF FIRE RETARDANT

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK.

Not Applicable

BACKGROUND OF THE INVENTION

This invention relates to fire fighting technology and particular to aerial fire fighting techniques.

Large area fires, such as forest and brush fires, present unique problems in containment and cause devastating effects on the environment, property and wild-life. They can spread quickly and can be difficult to contain and extinguish once they reach a certain size if there is an abundance of fuel and oxygen. Since they can start in very remote and inaccessible areas, attacking the fire from the air with "smoke jumpers" and spraying the area with fire retardant chemicals and/or water, with specially equipped low-flying aircraft and helicopters are commonly practiced fire fighting techniques. These aerial fire-fighting techniques are costly, risky to the fire-fighters and their aircraft and require a specially trained crew with diverse expertise.

A shortcoming of spraying of an area with fire retardant chemicals or water from aircraft is lack of precision in the delivery system. Inaccuracy is basically due to two factors, height and delivery speed. Due to concern for the safety of the aircraft, fire retardant chemicals or water are sprayed from a low flying aircraft from a height which is much higher than optimum. In addition when delivered with a relatively high flying speed they are dispersed to an area far larger than the desired target area so density and thus effectiveness on the target area is often less than optimal. The speed component of the inaccuracy of the delivery process can be somewhat eliminated by using a helicopter for the delivery. Using a bucket hanging from a helicopter with water or fire retardant chemicals has a higher probability of hitting a desired target. However, the amount that can be carried with helicopters is seldom enough to be effective, and it is very risky. In both methods, the lowest altitude of delivery of water or fire retardant chemicals is determined by the height of the flames and constraints imposed by smoke and air currents.

A more efficient and safer delivery system is needed for fighting fires.

SUMMARY OF THE INVENTION

According to the invention, a system is provided for launching, controlling and delivering in a preselected target pattern a plurality of low-cost, guided fire-retardant-containing vehicles, i.e., "smart water bombs" each containing water or fire retardant chemicals and equipped with control surfaces sufficient to provide limited lift and maneuverability to respond to guidance command to place it at a selected GPS coordinate within a large footprint in time and space and to discharge its payload of fire retardant at a preselectable altitude in a very precise manner and dispersion pattern.

Further according to the invention, a system is provided for determining how and how many of these "smart water bombs" can be dropped from a single plane or a squadron at different times and altitudes, as determined by a central controller according to the invention. The controller provides commands to each guided bomb so they each arrives at its target nearly simultaneously, or within short time intervals, forming a desired pattern to be saturated with water or fire retardant chemicals. The central controller includes a computer program that receives as inputs the area and the selected saturation pattern, flight characteristics of each guided bomb, intended time of target impact of each guided bomb, and projected and actual times and points of release of each guided bomb. The computer program calculates individual trajectories and issues instructions to each guided bomb to track the desired trajectory to avoid aerial collisions and to achieve the desired target. The program uses dynamic differential equations to determine trajectories and flight plans. The saturation pattern can for example be a rectangular area, a line with a width; a circular area, donut shaped area to encircle a region, etc., all displayed as an overlay on a map on the computer screen.

Working from the desired saturation pattern and a dynamic inventory of guided bombs and air transport vehicles, the program prepares a fire retardant delivery plan, including calculating the number of guided bombs needed and the number of aircraft needed from an inventory of then-available aircraft and bombs, including type and capacities, to deliver the retardant in the desired pattern or an alternative pattern. The program generates an integrated flight plan for all the aircraft and the guided bombs, so that all aircraft are launched, flown and return and all guided bombs are released and achieve their targets at the intended time and without collision. In a specific embodiment, each guided bomb is supplied with specific GPS target coordinates, a detonation height at which to explode, and the trajectory to follow so that all can hit their targets within an intended time window. A computer controlled coordinated fire attack using a plurality guided fire retardant-containing bombs allows for a very effective large scale fire fighting capability during early stages of the fire as well as during the uncontrollable phases of it.

The invention will be better understood by reference to the following detailed description in connection with the accompanying drawings.

DETAILED DESCRIPTION OF THE INVENTION

Figure 1:
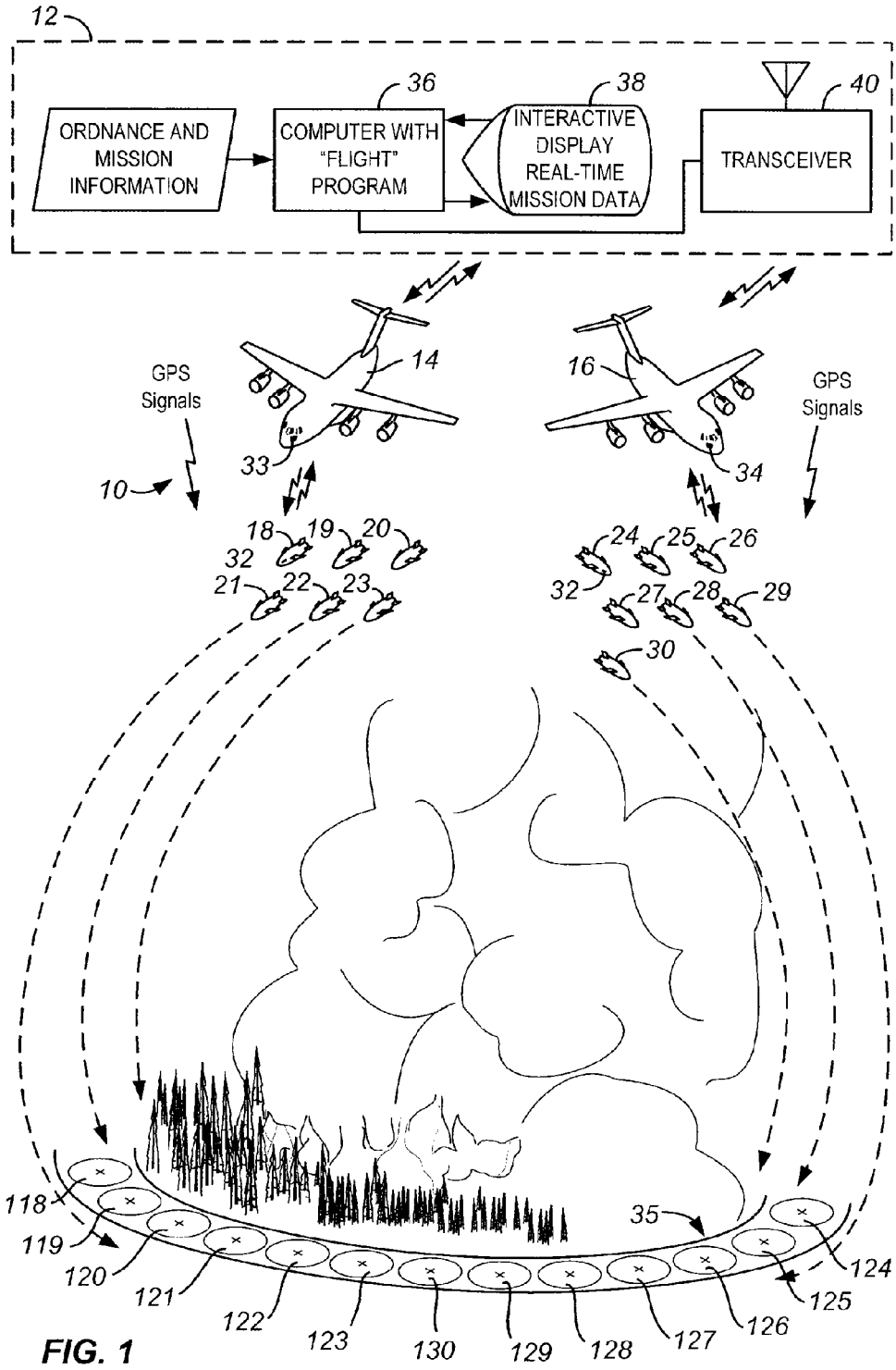
FIG. 1 is a diagram illustrating a typical flight capability of a guided fire retardant-containing bomb.
Figure 2:
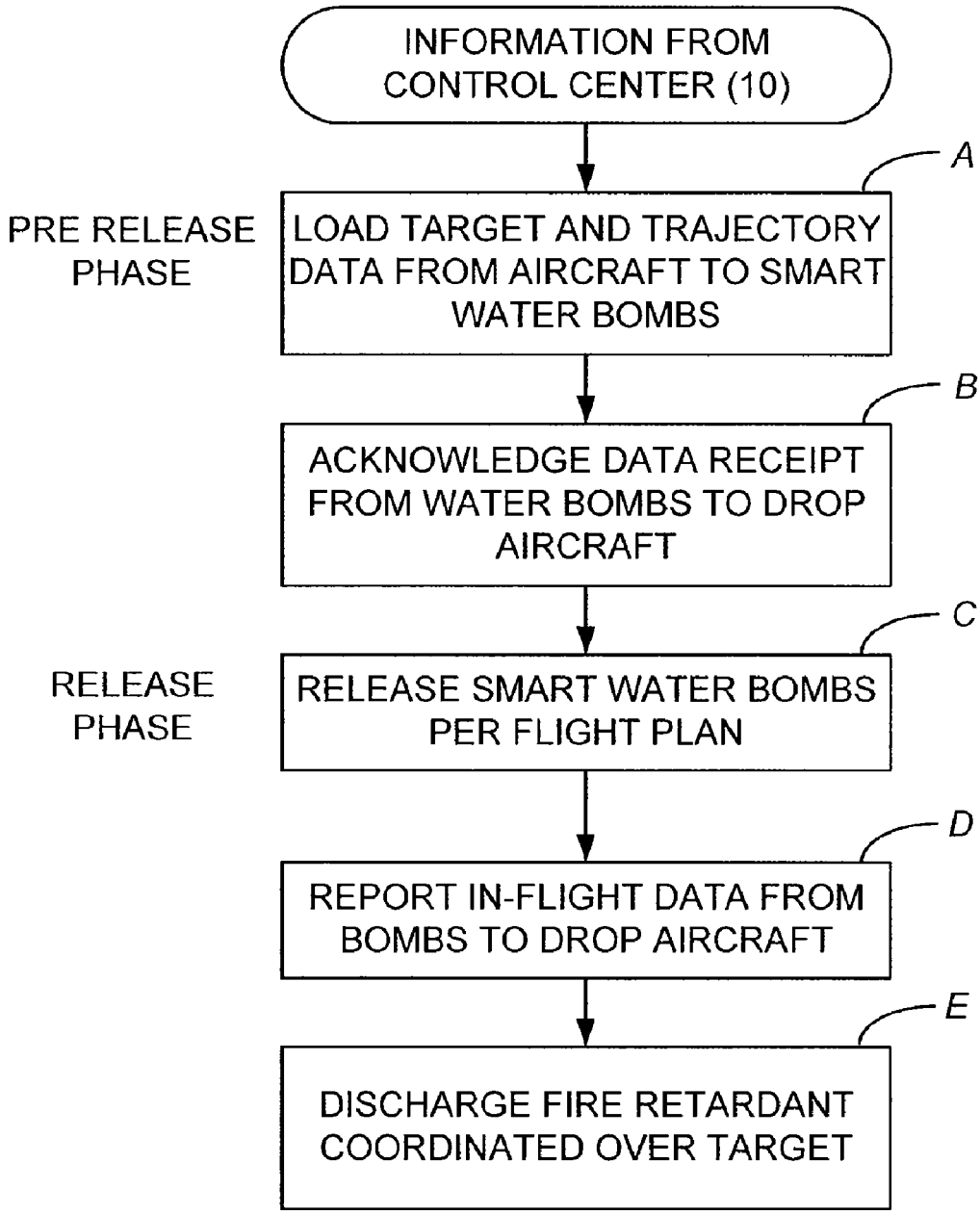
FIG. 2 is a flow chart of a system for delivering a pattern of guided bombs to fight a large-scale fire.

Referring to FIGS. 1 and 2, the invention comprises a system 10 implemented on a control center 12, drop aircraft 14, 16 and smart water bombs 18-30. In the smart water bomb 18-30, a two-way high data rate wireless communication system is implemented which supports point to multi-point capability, the point 33, 34 being the modules 32 in the drop aircraft 14, 16 and multi-point being in the smart water bombs 18-30 in this convention. The purpose of the two-way wireless data communication system capability is to load target coordinates, initial flight trajectory, initialization of GPS tracking information and control surface data from the drop planes 14, 16 (Step A) as generated locally or as received from a control center 10 to an onboard computer/flight controller 32-44 of the respective smart water bombs 18-30. This transmitted data is acknowledged back to the drop aircraft 14, 16 (Step B) for additional security and testing during the onboard flight, and it is updated if necessary. The drop aircraft 14, 16 then release the smart water bombs 18-30 (Step C) on a schedule according to the predetermined flight plan. After the release of the smart water bombs 18-30, the actual flight and control data during the flight are transmitted back to its drop plane 14, 16 (or a monitoring station) (Step D) for real time monitoring of the entire operation, from drop to target. The fire retardant is discharged at each of preselected positions 118-130, time and altitude at a target area 35, typically above the ground to allow for the retardant to be spread out (Step E).

Since there can be a very large number of smart water bombs 18-30 in an area at the same time, the wireless communication system 32 can be based on a cell phone communication system such as CDMA. This makes an inexpensive but reliable communication system with minimal electronic design effort put into the system with off-the-shelf components. Since a smart water bomb needs to communicate with the delivery aircraft 14, 16, the range of the wireless communication system is typically limited to the order of 20 miles from the drop aircraft 14, 16, with a directional antenna on the smart water bomb 18-30 that is provided with an upward lobe to reduce the required RF transmit power.

A bomber or a fighter bomber may be called upon to drop many of these smart water bombs while flying with a non-zero air and ground speed with some time intervals between releases, so the smart water bombs must be such as to allow all to achieve the same target coordinate if dropped higher than a reasonable but predictable altitude and within an extended release window in time and space. Therefore the most challenging mathematical problem is the calculation of a four-dimensional drop zone of volume and time with large enough volume where many aerial vehicles (bombs and planes) can reside in it at the same time for safely dropping large numbers of smart water bombs directed to a target coordinate. A typical drop zone height is well over 5,000 feet, which is a safe height for the aircraft.

The control center 12 is used for managing the system 10. The control center 12 includes a computer 36 and a transceiver 40 and is preferably equipped with visual monitoring equipment, including an interactive display capability. Through this capability, a fire control operator at the control center 12 should be able to designate a spray pattern around a fire by marking the region on the map displayed on a display screen 38 of the computer 36. Using input data derived from the marking, the computer 36 of the control center 12 can calculate the number of bombs needed and their target coordinates. In this calculation, wind data are also taken into consideration. From the aircraft availability data, usable air bases will be identified. Flight plans and drop zone for each aircraft, along with the flight plans of individual smart water bombs may be calculated. Since there is time needed from the detection of a fire to deploying aircraft with their payload to their drop zones, weather data will be crucial in predicting the spreading of the fire during that response time. Therefore the drop zones of the delivery aircrafts and the flight trajectory data for every smart water bomb might be updated as the delivery aircraft approaches the vicinity of their initially calculated drop zones to then current conditions. This makes the point to multi-point wireless communication capability between the delivery aircraft 14, 16 and the smart water bombs 18-30 necessary.

It is contemplated that many smart water bombs are to be dropped simultaneously or with short time intervals between them, from the same plane or from many planes that can be in a close proximity formation. Since one of the goals is to direct the smart water bombs to fall in a coordinated fashion, collision between them. To minimize this risk, pre-programmed flight trajectory data is fed to all smart water bombs, the patterns being chosen so they do not intersect individually before their release. Obviously the pre-programmed flight trajectory cannot be arbitrary; it has to satisfy the ballistics and aerodynamic characteristics of the smart water bombs. This requires a fairly complex computer program to set the trajectory or the flight plan that satisfies the equation of motion of the smart water bombs with an initial spatial coordinates and velocity with the desired target coordinates. The name of this computer program is "Flight," and it is available as a commercial product from OEA International, Inc., of Morgan Hill, Calif.

"Flight" is basically a very fast non-linear ordinary differential equation solver that calculates the trajectory of a three dimensional object in the shape of a smart water bomb by taking its aerodynamic and mechanical properties into account with given initial coordinate and velocity vector information, along with time-dependent control surface angles with respect to its body reference during the flight. To do this task, a set of six non-linearly coupled non-linear ordinary differential equations are solved as a function of time. Three of them are related to the motion of the object in x, y and z axes and the remaining three are the three equations related to the rotation of the object in three axes of rotation. For those wishing to prepare their own version of this program, excellent references on the basics of the subject are covered in *Aerodynamics, Aeronautics, and Flight Mechanics*, B. W. McCormick, Wiley and Sons, 1979, ISBN 0-471-03032-5, and *Flight Stability and Automatic Control*, Robert C Nelson, McGraw Hill, Copyright 1998, Second Edition, ISBN -13: 978-0-07-046273-1.

The method of solution is based on non-linear fourth order Runge-Kutta method disclosed in *Applied Numerical Analysis*, C. F. Gerald, Addison-Wesley Publishing Co., 1980, ISBN 0-201-02696-1. Since air density changes dramatically with altitude, this effect is also included in the lift/drag calculations as a function of attack angle of the control surfaces such as wings, rudder, elevator and ailerons. Forces acting upon the wings, ailerons and rudder are calculated as a function of their attack angles with respect to the trajectory. There are numerous literature sources to determine lift and drag coefficients as a function of attack angles for many airfoil sections. See for example B. W. McCormick, *Aerodynamics, Aeronautics, and Flight Mechanics*, Wiley and Sons, 1979, ISBN 0-471-03032-5; I. H. Abbott and A. E. Von Doenhoff, *Theory of Wing Sections*, Copyright 1949, 1959, Dover Publications, Inc., ISBN 0-486-60586-8; M. S. Rice, *Handbook of Airfoil Sections for Light Aircraft*, copyright 1971, Hector Cervantes, Inc.

The "Flight" program uses the piece-wise linear approximation of the lift and drag coefficients of the selected airfoil data to incorporate them in the force and resulting moment calculations. The user can easily select any kind of airfoil section for wings, ailerons and the rudder from its library. As can be seen "Flight" is not an aiming or guidance control program, but it is an part of them. The simulation results of the "Flight" program are used to calculate the drop zone volume to hit a desired target coordinate.

Figure 3:
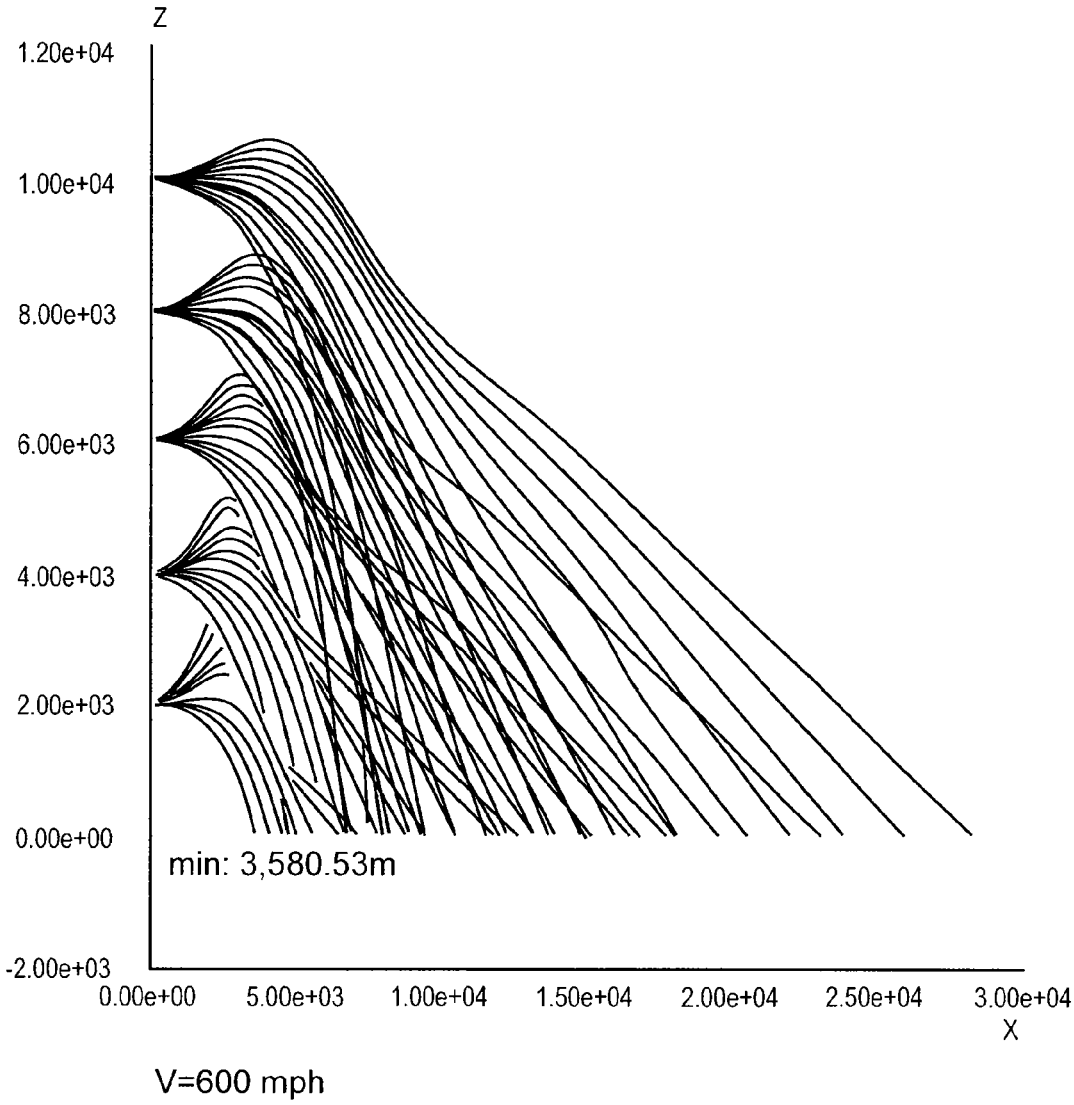
FIG. 3 is a graph showing the altitude (z) versus range (x) flight trajectories for a design at a release velocity of 600 mph.
Figure 4:
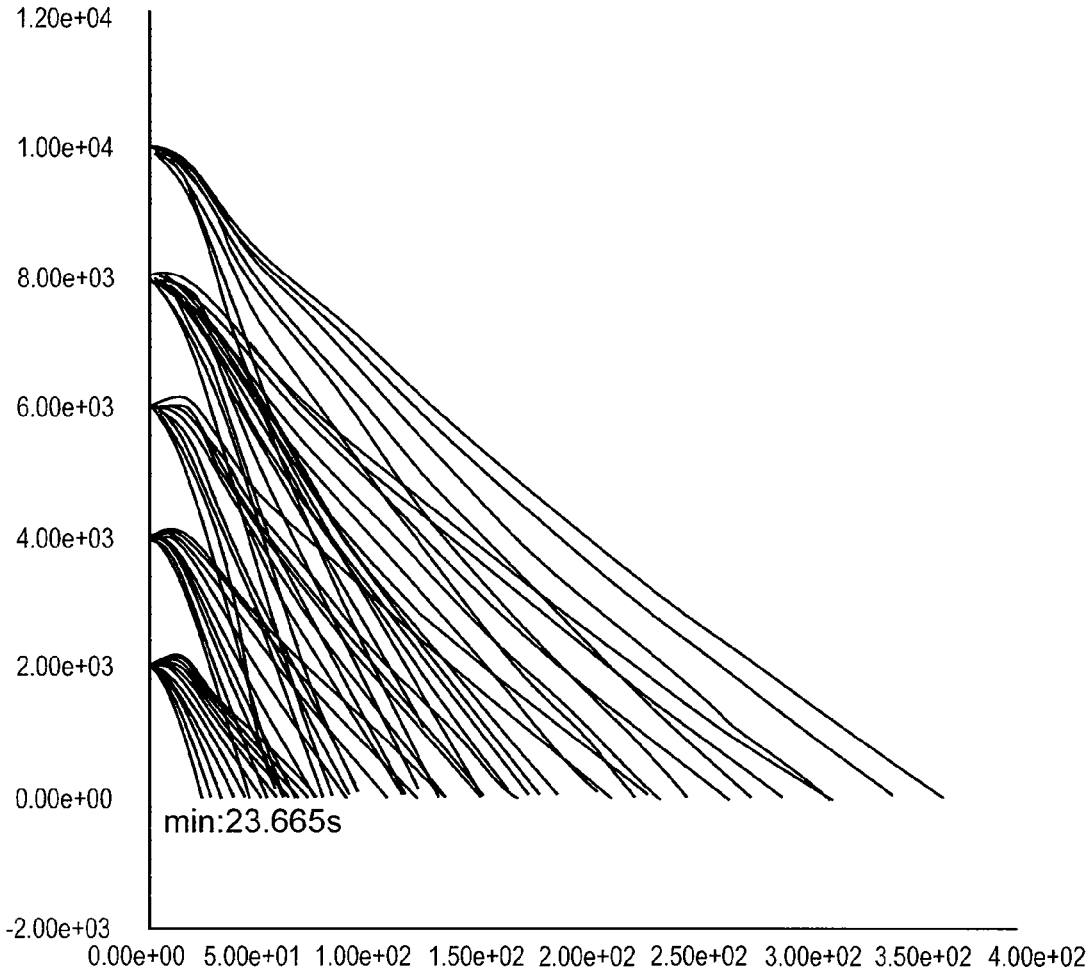
FIG. 4 is a graph showing the altitude (z) versus flight time (t) for the same design for release velocity of 300 mph.
Figure 5:
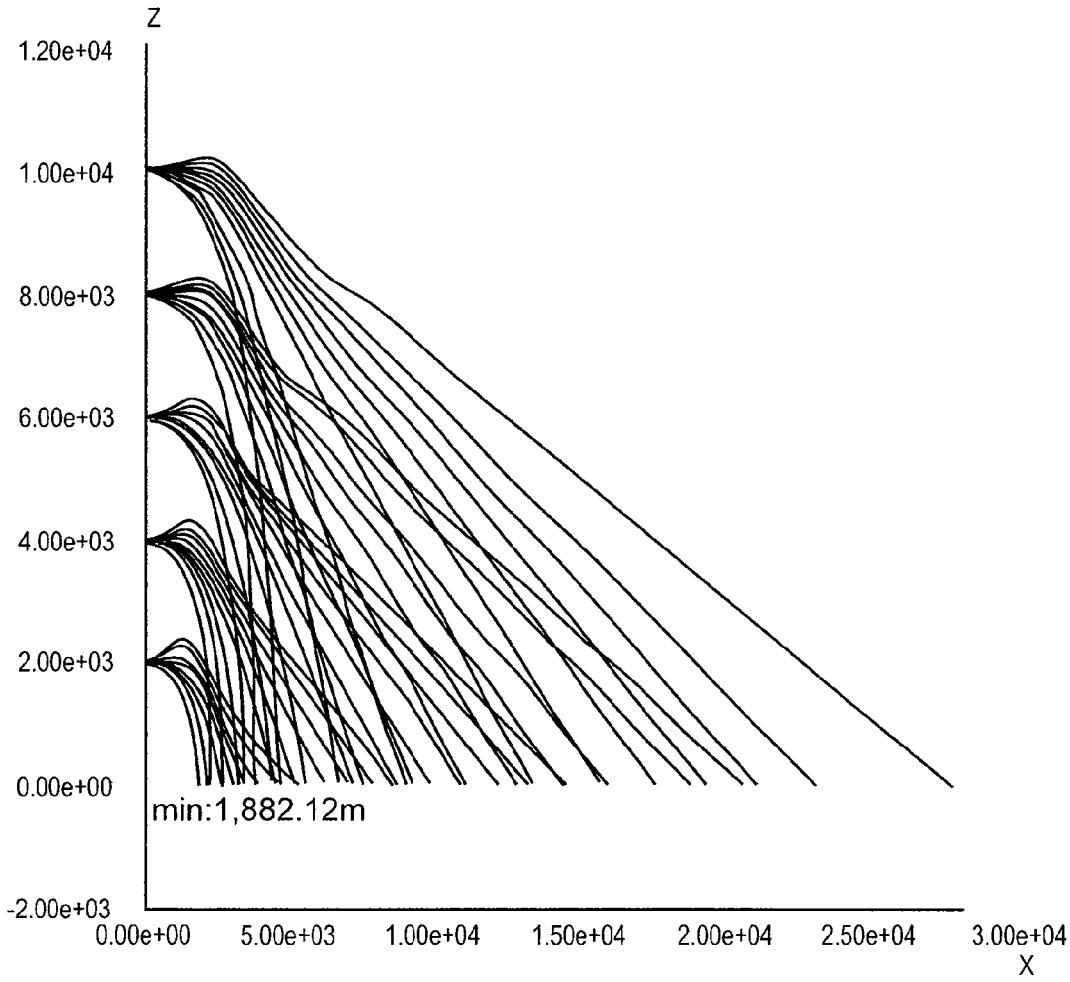
FIG. 5 is a graph showing the altitude (z) verses range (x) for the same design for a release velocity of 400 mph.
Figure 6:
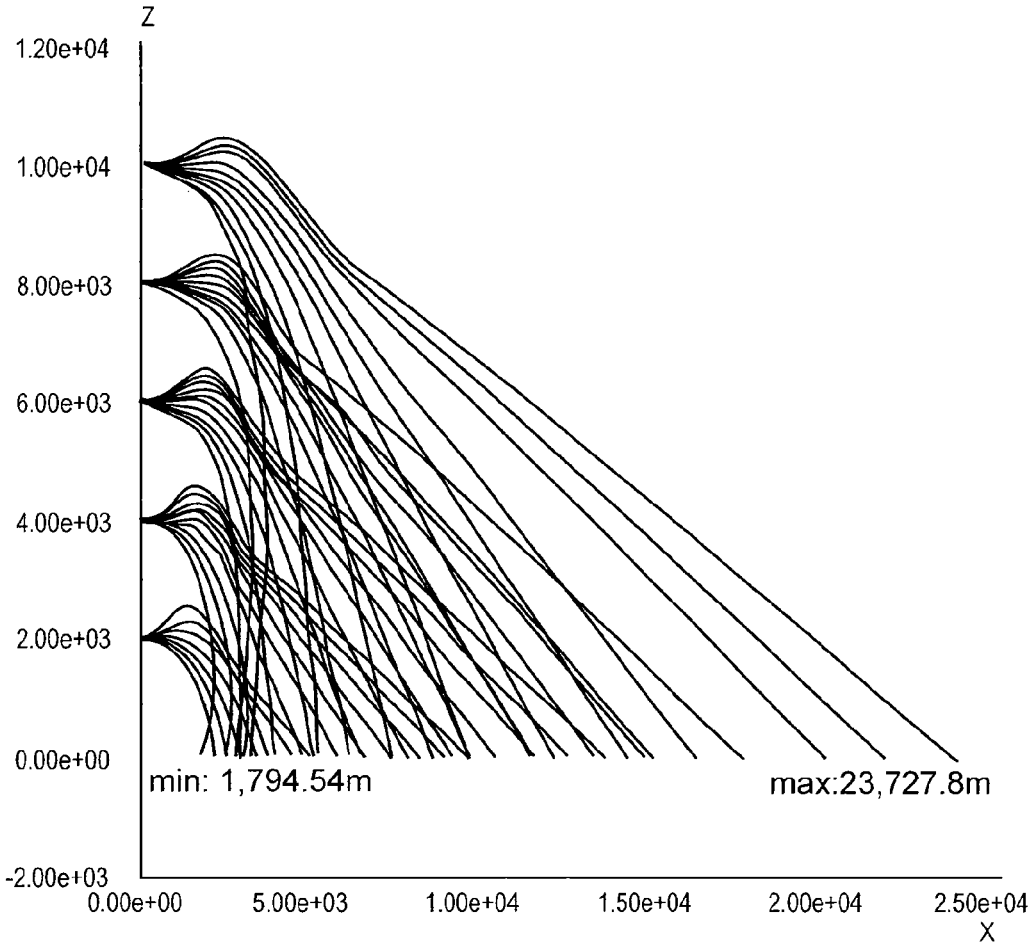
FIG. 6 is a graph showing the altitude (z) verses range (x) for the same design for a release velocity of 500 mph.
Figure 7A:
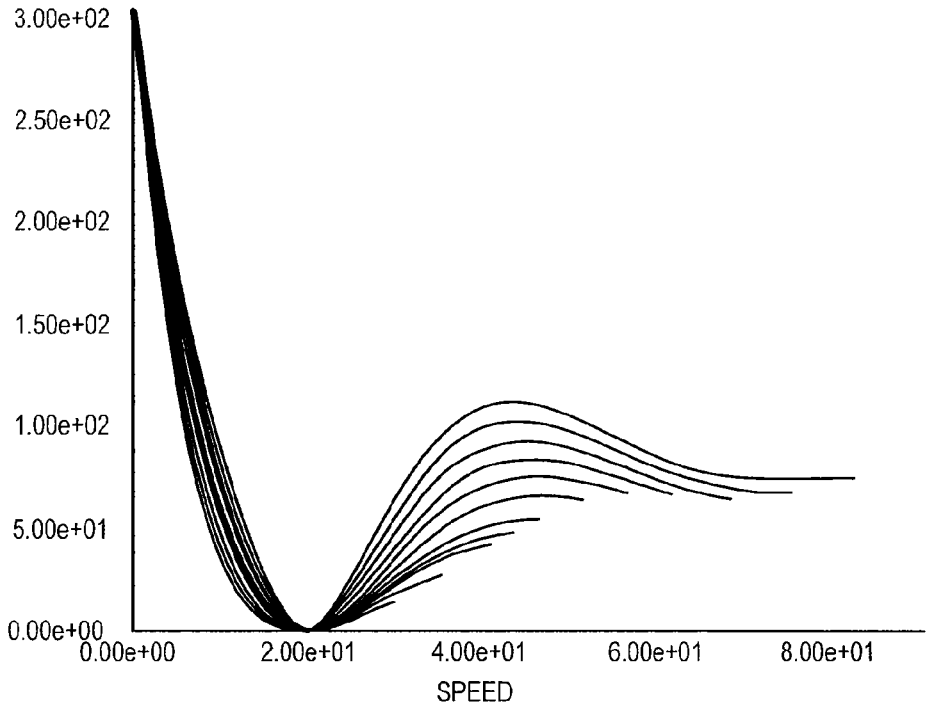
FIG. 7A shows the speed as a function of time when the design is dropped from 2,000 meters at 600 mph with terminal or impact velocities in the order of 120 to 181 mph.
Figure 7B:
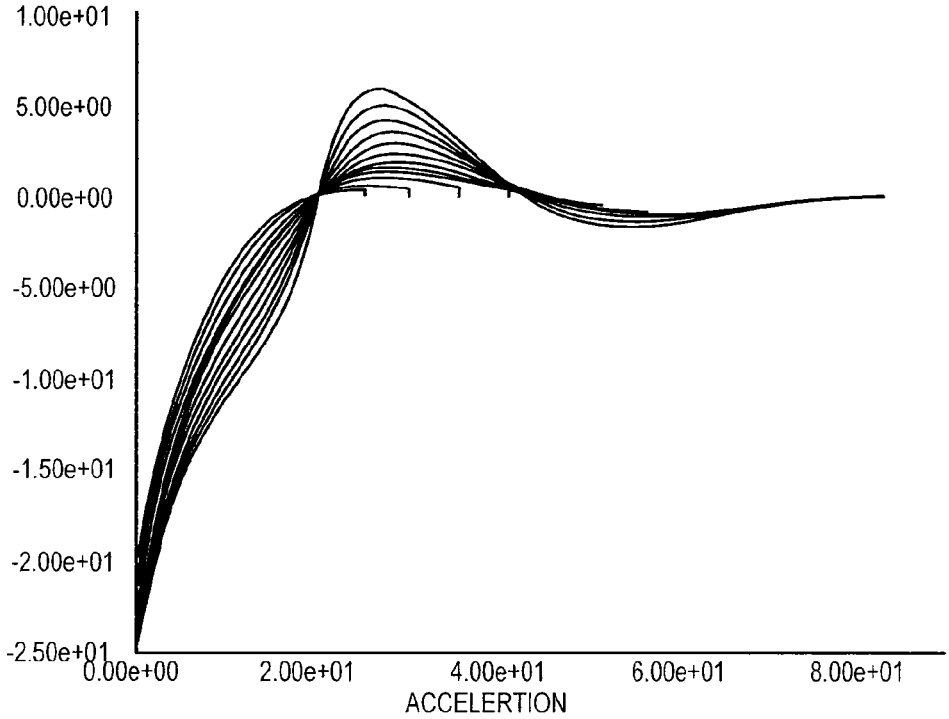
FIG. 7B shows the acceleration as a function of time when the design is dropped from 2,000 meters at 600 mph with terminal or impact velocities in the order of 120 to 181 mph.

FIG. 3 shows the altitude (z) versus range (x) flight trajectories obtained by the "Flight" program of a 1500 kg glider vehicle with a type FX-61-184 wing of 1 square meter and type NACA 0009 tail of 0.3 square meter, where the tail angel or attack and wing angle of attack are preset variously as shown when dropped from various altitudes of 2,000, 4,000, 6,000, 8,000 and 10,000 meters as shown at a 600 mph of release speed. In all cases the wing attack angle with respect to the air flow, or in other words with respect to the trajectory, are continuously maintained at a set value during the entire flight by constantly controlling the elevator angles with respect to the fuselage reference axes. In all trajectories the wing attack angles are taken between −4 to 6 degrees with 1 degree increments. As can be seen the trajectory ranges are in between 3,580 to 28,320 meters. This is a fairly large foot print along x axes for this application. For higher wing attack angles the design gains a relatively higher altitude at lower release altitudes compared to the higher release altitudes due to the increase in the lift for the same air speed due to increase in the air density. FIG. 4 shows the altitude (z) versus flight time (t) for the same design for release velocity of 300 mph. FIG. 5 and FIG. 6 show the altitude (z) verses range (x) for the same design for 400 and 500 mph release velocities respectively. As can be seen they are in the range of 24 to 370 seconds with impact velocities of 120 to 181 mph. Trajectories involving banking with simultaneous aileron and rudder controls cause a reduction in the range. The expected lateral (y) control is on the order of 3,000 to 5,000 meters, which defines also a very adequate foot print along y axes. FIG. 7A shows the speed as a function of time when the design is dropped from 2,000 meters at 600 mph with terminal or impact velocities in the order of 120 to 181 mph. FIG. 7B shows the acceleration under the same conditions. The "Flight" program has sufficient sophistication to calculate the flight trajectories as a function of elevator, rudder and aileron angles over a function of time. This type of detailed computation and simulation capability is crucial for the control system.

The number of combinations of drop speed, altitude and wing attack angles with respect to the airflow—in other words trajectory—yields trajectories passing through the target coordinates is infinite. The number of combinations increase greatly with complex flight patterns in the solution space. A reasonable selection has to be done based on "safe" flight characteristics and control capabilities of the smart water bomb, which leads to a simple and stable control system. Therefore setting the wing attack angle to a constant value during the flight with respect to airflow, or in other words fixing the trajectory, reduces the solutions space to a manageable size. During this selection, its is prudent to add into the equation the criteria of maintaining the wing, elevator and rudder so they never stall and smooth flight is always maintained. These criteria are not only necessary to have accurate simulations results from the "Flight" program but also to have a more stable on-board control system.

Drop Zone Calculation

Figure 8:
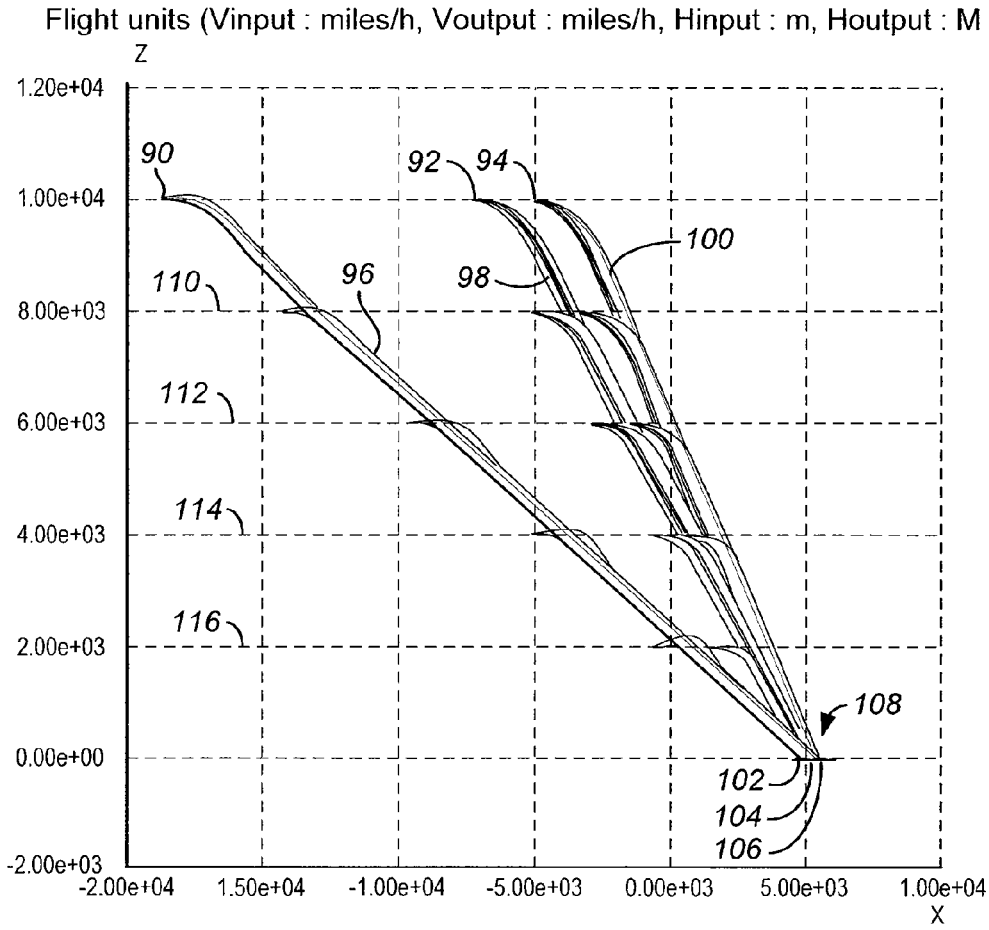
FIG. 8 is a graph showing flight units for various release ranges and altitudes.

As shown in FIGS. 3, 5 and 6, the smart water bomb drop coordinates for a given target coordinate set depend on the altitude, drop speed, wing attack angle with respect to the air flow and wind conditions. Since the "Flight" program is basically an initial value problem solver, it cannot calculate the range directly. However, using the "Flight" program, a precalculated dataset as shown FIGS. 3, 5 and 6 is constructed for rapid calculation of the required safe and controllable drop coordinates of all of the smart water bombs with respect to the target coordinates and for a given delivery speed and set wing attack angles with respect to the air flow. After fire control at the control center 12 selects or decides the target coordinates, the altitude, speed and course of the delivery aircraft 14, 16 are calculated based on this data. Using the stored data and working backwards from the target coordinates, the drop coordinates for each smart water bomb will be obtained. The independent variable may for example be time separation between releases. The example is given in FIG. 8 for 300 mph drop velocity from 2,000, 4,000, 6,000 and 10,000 meters, where a first release is made at point 90, a second release at point 92, a third release at point 94 and each release point 90, 92, 94 follows its respective trajectory 96, 98, 100 to its respective target 102, 104, 106, in a tight cluster 108. Various release altitudes can achieve the same trajectory when released at the appropriate times for those altitudes. Similar trajectories can be determined for various drop velocities. Thus, the same target coordinate can be hit from various altitudes and distances from the target within a short time interval. In addition, smart water bomb so launched can all hit the same target and any other target coordinate in the range of $\Delta x = +/-500$ meters of the target by mere elevator control while always being in the safe flight envelope.

Control System

The program for the real-time flight control system is based on a predictor-corrector algorithm that uses the same fourth order Runge-Kutta based differential equation solution method used in the "Flight" program, but in real time. There are many uncertainties during the flight, so the control system 12 must be able to take those into consideration. Moreover, a mathematical model of the smart water bomb will not be not perfect, since it is based on an average or an idea, so some effects like fuselage wing, wing to elevator and tail control surface interactions, tapering of the wing and many other effects must be taken into consideration empirically with some approximations. Since the first flight of each smart water bomb will also be its last, no in-flight calibration or trimming is possible. In addition, there are many uncertain parameters in the initial phase of the flight such as the time it takes for the retractable wing deployment and the attitude of the glider when the wings are deployed. In addition to those the wind speed and direction at different altitudes are also important unknowns. Therefore constant course corrections are needed during the flight to follow the precalulated trajectory and to home on the target based on feedback through the GPS coordinate input that is compared with the precalculated trajectory. Hereafter is the sequence of events that takes place in the deployment.

Pre-Release Phase

Figure 9:
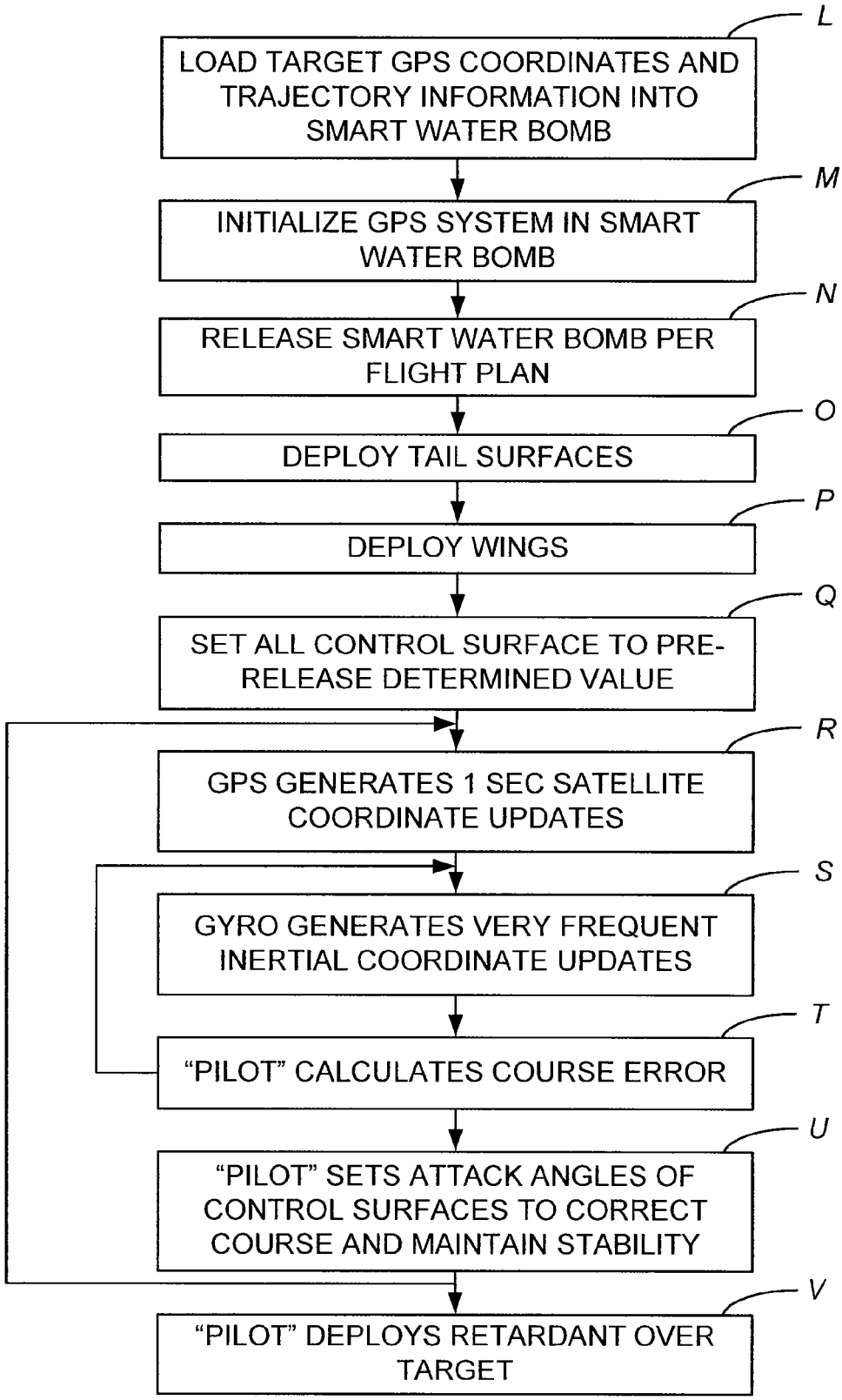
FIG. 9 is a flow chart for the process of deployment.

The pre-release phase takes place in the drop aircraft. Referring to FIGS. 2 and 9, the target GPS coordinates and the approximate trajectory information are loaded into the guidance computer of all smart water bombs (Step L or A). This is done using the two-way wireless communication system between the delivery aircraft 14, 16 and its smart water bombs while still on board. GPS systems must also initialize (Step M) which takes time, on the order of 300 seconds to about 15 seconds for off-the-shelf systems, depending on the initialization conditions. After this initialization phase, which is used to acquire the satellite information to be used for navigation, the GPS system can give coordinate information every second. Since the initialization time for the GPS system is almost on the order of the duration of an entire flight time, it must be done before release. Moreover, smart water bombs are carried in the fuselage or under the wings of the delivery aircraft, which can make the reception of the GPS signal inadequate. Therefore, the initial satellite tracking information, heading, velocity and initial coordinate information are constantly supplied to the smart water bombs by its delivery aircraft before release.

Release Phase

In the release phase, the smart water bomb is released from the drop aircraft (Step N or C). First, the retractable tail control surfaces are deployed with 0 degrees angles with respect to the fuselage axes (Step O). Since the smart water bomb is designed as a nose heavy glider, it will slightly nose dive. After it drops approximately 50 meters, the retractable wings are deployed (Step P). This whole phase takes on the order of 4 to 8 seconds. Then the control surfaces will be set to the pre-release-determined values as they have been calculated in drop zone process (Step Q). The on-board GPS system, which was initialized by the drop aircraft before release, starts giving coordinate, velocity and heading information with time intervals of a second (Step R). The three axis gyro data for the pitch, yaw and roll angles along with air speed and all of the control surface angle data from the encoders attached to them starts feeding the onboard "Pilot" navigation system with a much higher rate than the GPS coordinate data (Step S). "Pilot" will always control the directional stability of the smart water bombs and maintains elevator attack angles such that the wing attack angle is always kept at a given value. This does not require frequent GPS information other than in the calculation of the trajectory, so it is a standard negative feedback control system.

Aiming Phase

As mentioned earlier, the trajectory of the smart water bomb can be calculated with initial coordinate and velocity information with the control surface data as a function of time by the Flight program. To limit the number of possible simulations to a manageable number, only a few wing attack angles are specified to be continuously controlled by the elevators to maintain a constant wing attack angle with respect to the airflow or in other words trajectory. At every GPS coordinate update, which is on the order of one per second, "Pilot" calculates trajectories from that coordinate with the initial values of the velocity components in increments of 0.5 degrees between the negative to positive stall angles of the wing and elevators (Step T). This yields maximum of 40 fourth-order Runge-Kutta simulations by the embedded "Flight" program in the "Pilot." From the set of the simulations, "Pilot" selects the best wing attack angle θ by doing linear interpolation between two trajectories giving closest impact coordinates to the target (Step U). The wing attack angle is maintained at θ until the next correction point by continuously controlling the needed elevator angle. The same process is repeated for every GPS coordinate update, until the "Pilot" senses altitude and position over the target, whereupon it deploys the fire retardant by triggering a small core charge that disintegrates the smart water bomb over the target surface (Step V or E).

This method is effective, but it is not unconditionally convergent. Convergence criteria can be mathematically derived and be proven by simulations. It can be shown however, that the method is convergent if the maximum time between corrections is less than a critical value which is determined by the maximum error in range prediction and the selected trajectory itself. The method of finding the convergence criterion is similar to that which has been explained in the inventor's published paper: O. E. Akcasu, "Convergence Properties of Newton's Method for the Solution of Semiconductor Carrier Transport Equations and Hybrid Solution Techniques for Multidimensional Simulation of VLSI Devices," *Solid-State Electronics* Vol. 27, pp. 319-328, April 1984.

Since simulation programs, and in particular the "Flight" program, are not perfect, some empirical approximations in the aerodynamic model of the smart water bomb are useful. In addition, air velocity and density are also not known for all the coordinates of the trajectory during flight. This will result in errors in predicting the wing attack angle needed to hit the target from long distances and will reduce the duration of the time interval between corrections if the method is to remain convergent. The methods for convergence can be improved greatly by making local corrections to the predicted wing attack angles. First, always assume there is an error in the predicted trajectory that increases with time. This assumption is valid and straightforward and can be derived by using the Taylor expansion of a continuous function in the neighborhood of t. In other words the predicted trajectory is more accurate for shorter times, or in the vicinity of t. So one can check the accuracy of the predicted trajectory between wing attack angle correction points, which are the shortest time intervals that can be used for this purpose in the control algorithm that occur during flight.

Assume at time $t_i$, $\theta_i$ is the predicted wing attack angle using the embedded "Flight" program in the "Pilot" guidance control program to hit the target. The next time discretization point is given as $$t_{i+1}=t_i+\Delta t. \tag{1}$$

Due to the uncertainties of the wind velocity and the imperfections in the physical and aerodynamic model, the trajectory coordinate errors at $t_{i+1}$ in three dimensions can be represented as $$\Delta x=x_{i+1}-x^{\alpha}_{i+1} \tag{2}$$

$$\Delta y=y_{i+1}-y^{\alpha}_{i+1} \tag{3}$$

and $$\Delta z=z_{i+1}z^{\alpha}_{i+1} \tag{4}$$

where $x^{\alpha}_{i+1}$, $y^{\alpha}_{i+1}$ and $z^{\alpha}_{i+1}$ are the actual trajectory coordinates obtained from the GPS system and $x_{i+1}$, $y_{i+1}$ and $z_{i+1}$ are the predicted coordinates by maintaining $\theta_i$ attack angle of the wing with respect to the trajectory during the time duration of Δt.

In addition, the GPS system can also give the velocity errors by comparing the actual versus simulated velocities at time $t_{i+1}$. For the sake of explaining the aiming algorithm in its simplest form, assume that the only non-zero error is in the altitude $z_{i+1}$, which is represented by Δz. From the set of Runge-Kutta simulations done at time $t_i$ where the $\theta_i$ was calculated to hit the target, the trajectory that passes from the actual $z^{\alpha}_{i+1}$ at $t_{i+1}$ is selected. At this point a similar interpolation is also needed as done for the calculation of $\theta_i$. The corresponding wing attack angle to the selected trajectory is represented by $\theta^{c}_{i+1}$. At the same time, at time $t_{i+1}$, $\theta^{P}_{i+1}$ is calculated which uses the actual $x^{\alpha}_{i+1}$, $y^{\alpha}_{i+1}$, $z^{\alpha}_{i+1}V^{\alpha}_{xi+1}$, $V^{\alpha}_{yi+1}$ and $V^{\alpha}_{zi+1}$ information from the family of Runge-Kutta simulations to hit the target. Since there was an error of Δz for the duration of flying time of Δt, the $\theta^{P}_{i+1}$ is corrected using the calculated $\theta^{c}_{i+1}$ value simply by proportionality as $$\theta_{i+1}=k\theta^{P}_{i+1} \tag{5}$$

where k is $$k=\theta_i/\theta^c_{i+1} \quad (6)$$

As can be seen, if $\theta_i=\theta^c_{i+1}$, there was no trajectory error for the flight duration of $\Delta t$, giving k=1 and no correction is necessary on $\theta^P_{i+1}$.

This control algorithm is very easily adaptable as software in the "Pilot" for accurate aiming of the smart water bombs. The algorithm repeats itself for every $\Delta t$ in the flight.

The convergence property of the method can be tested with a large number of Monte Carlo simulations. In the Monte Carlo analysis, the disturbances such as wind velocity, errors in GPS data and physical parameters of the smart water bombs are analyzed to predict the probability of hitting a target with a given dimensions.

The same algorithm can be used for the directional control of the smart water bombs. Instead of controlling the elevator, the control system will generate rudder, aileron and elevator control signals.

Control Hardware

To implement the control algorithm explained above efficiently and cheaply, an integrated circuit may be provided that is basically a Runge-Kutta solver engine. Since "Pilot" uses on the order of 40 Runge-Kutta simulations to predict the trajectories of the smart water bombs from each time sample to impact, which all have to complete in a fraction of $\Delta t$, parallelization of the Runge-Kutta algorithm is very useful. This will reduce the entire control system to a single chip and will result in cost and space savings along with increased reliability. Basically the chip will have three axes accelerometer inputs, GPS data as inputs and will have wing and corresponding elevator angle, rudder and aileron angles for each time sample as an output. An additional serial port to load the Runge-Kutta parameters related to the physical model of the smart water bombs—and some other program control data—makes this a fairly low pin count chip.

The disclosed invention provides a system for fight fires more effectively using a plurality of guidable delivery vehicles for water or fire retardant that can deliver it accurately and in a coordinated fashion. The invention has been explained with reference to specific embodiments. Other embodiments will be evident to those of ordinary skill in the art. It is therefore not intended that this invention be limited, except as indicated by the appended claims.

What is claimed is:

1. A system for fighting large-scale fires comprising:

a plurality of guidable fire retardant-containing bombs configured to be released from a plurality of aircraft operating under a central controller, said guidable bombs having internal control for accepting at the time of said release preprogrammed information on a specified trajectory and configured to precisely follow the specified trajectory without internal propulsion, said guidable bomb being characterized by a versatile controlled flight capability including a capability to substantially redirect path of flight horizontally in response to internal real-time control inputs;

a central controller configured to receive as input fire pattern information at a target, information on available number, retardant capacity and flight capability of said guidable bombs, and information on available number, carrying capacity and flight capability of said aircraft for delivering said guidable bombs, said central controller being operative to generate a fire attack plan, said fire attack plan providing individual flight plans for each aircraft and a trajectory for each one of said guidable bombs, and a communication means for communicating at least said trajectory to each of said guidable bombs.

2. The system according to claim 1 wherein said flight capability of said guidable bombs includes flight characteristics of each guidable bomb, and wherein said trajectory includes intended time of target impact of each guidable bomb.

3. The system according to claim 2 wherein said controller is configured to receive as input projected and actual times and points of release of each guidable bomb for recalculating trajectory and for issuing concurrent with release instructions to each guidable bomb to track the desired trajectory in order to avoid aerial collisions and to achieve the desired target at a desired window of time.

4. The system according to claim 3 wherein said controller comprises computer instructions of dynamic differential equations to determine trajectories and flight plans, which instructions when executed on a processor to operate control surfaces guide said guidable bombs.

5. A method for fighting large-scale fires comprising:

receiving at a central controller fire pattern information at a target, information on available number, retardant capacity and flight capability of guidable fire retardant-containing bombs, and information on available number, carrying capacity and flight capability of aircraft for delivering said guidable bombs;

generating at said central controller a fire attack plan, said fire attack plan providing individual flight plans for each aircraft and a trajectory for each one of said guidable bombs;

communicating preprogrammed information on a specified trajectory to each of said guidable bombs concurrent with release;

releasing a plurality of said guidable bombs from a plurality of aircraft operating under instruction of the central controller, said guidable bombs internal controlling flight path to precisely follow the specified trajectory without internal propulsion, said guidable bomb being characterized by a versatile controlled flight capability including a capability to substantially redirect path of flight horizontally in response to internal real-time control inputs thereby causing the guidable bombs to saturate a target in a predetermined pattern according to the fire pattern.

6. The method according to claim 5 wherein said flight capability of said guidable bombs includes flight characteristics of each guidable bomb, and wherein said trajectory includes intended time of target impact of each guidable bomb.

7. The method according to claim 6 further comprising receiving at said controller as input projected and actual times and points of release of each guidable bomb for recalculating trajectory and for issuing concurrent with release instructions to each guidable bomb to track the desired trajectory in order to avoid aerial collisions and to achieve the desired target at a desired window of time.

8. The method according to claim 7 wherein said controller comprises computer instructions of dynamic differential equations to determine trajectories and flight plans, which instructions when executed on a processor to operate control surfaces guide said guidable bomb.

* * * * *